US011271326B2

(12) United States Patent
Fang et al.

(10) Patent No.: US 11,271,326 B2
(45) Date of Patent: Mar. 8, 2022

(54) ANTENNA SYSTEM

(71) Applicant: Wistron Corp., New Taipei (TW)

(72) Inventors: Ying-Sheng Fang, New Taipei (TW); Po-Tsang Lin, New Taipei (TW); Chia-Wei Su, New Taipei (TW); Pei-Cheng Hu, New Taipei (TW)

(73) Assignee: WISTRON CORP., New Taipei (TW)

( * ) Notice: Subject to any disclaimer, the term of this patent is extended or adjusted under 35 U.S.C. 154(b) by 30 days.

(21) Appl. No.: 16/281,336

(22) Filed: Feb. 21, 2019

(65) Prior Publication Data

US 2020/0235491 A1 Jul. 23, 2020

(30) Foreign Application Priority Data

Jan. 22, 2019 (TW) ..... 108102350

(51) Int. Cl.

| | |
|---|---|
| ***H01Q 21/08*** | (2006.01) |
| ***H01Q 9/06*** | (2006.01) |
| ***H01Q 1/48*** | (2006.01) |
| ***H01Q 21/00*** | (2006.01) |

(52) U.S. Cl.

CPC ..... *H01Q 21/08* (2013.01); *H01Q 1/48* (2013.01); *H01Q 9/06* (2013.01); *H01Q 21/0006* (2013.01)

(58) Field of Classification Search

CPC ..... H01Q 21/00; H01Q 21/06
USPC ..... 343/848, 893
See application file for complete search history.

(56) References Cited

U.S. PATENT DOCUMENTS

| | | | | |
|---|---|---|---|---|
| 7,675,466 | B2 * | 3/2010 | Gaucher | H01Q 21/0006 343/700 MS |
| 10,297,916 | B2 * | 5/2019 | Ku | H01Q 21/08 |
| 2003/0034920 | A1 * | 2/2003 | Lee | H01Q 21/065 343/700 MS |
| 2007/0126641 | A1 * | 6/2007 | Saily | H01Q 9/0457 343/700 MS |
| 2007/0229359 | A1 * | 10/2007 | Heyde | H01Q 9/0442 343/700 MS |

(Continued)

OTHER PUBLICATIONS

Machine Translation of Publication: JP2000059136 A, Feb. 25, 2000 (Year: 2000).*

(Continued)

*Primary Examiner* — Amy Cohen Johnson
*Assistant Examiner* — James H Cho
(74) *Attorney, Agent, or Firm* — McClure, Qualey & Rodack, LLP

(57) ABSTRACT

An antenna system includes a dielectric substrate, a ground plane, and a first antenna array. The ground plane is disposed on a second surface of the dielectric substrate. The first antenna array is disposed on a first surface of the dielectric substrate. The first antenna array includes a first transmission line, a first antenna element, a second antenna element, a third antenna element, a fourth antenna element, a fifth antenna element, and a sixth antenna element. The first transmission line has a first feeding point and is coupled to the first antenna element, the second antenna element, the third antenna element, the fourth antenna element, the fifth antenna element, and the sixth antenna element. The first antenna element, the second antenna element, the third antenna element, the fourth antenna element, the fifth antenna element, and the sixth antenna element are all substantially arranged in a first straight line.

15 Claims, 8 Drawing Sheets

(56) References Cited

U.S. PATENT DOCUMENTS

2008/0180336 A1* 7/2008 Bauregger ..... H01Q 19/062 343/753
2008/0258981 A1* 10/2008 Achour ..... H01Q 21/065 343/702
2008/0258989 A1* 10/2008 Rao ..... H01Q 9/045 343/770
2009/0009399 A1* 1/2009 Gaucher ..... H01Q 21/0006 343/700 MS
2009/0219213 A1* 9/2009 Lee ..... H01P 5/185 343/700 MS
2009/0231225 A1* 9/2009 Choudhury ..... H01Q 1/2283 343/770
2010/0104054 A1* 4/2010 Scott ..... H01Q 1/1257 375/347
2010/0177012 A1* 7/2010 Morrow ..... H01Q 21/0025 343/893
2011/0050534 A1* 3/2011 Shimayama ..... H01P 5/028 343/850
2014/0269389 A1* 9/2014 Bukkfejes ..... G01S 3/48 370/252
2018/0241135 A1* 8/2018 Furlan ..... H01Q 21/0006
2019/0115664 A1* 4/2019 Veihl ..... H01Q 5/385
2020/0014113 A1* 1/2020 Asaka ..... H01Q 21/065
2020/0036103 A1* 1/2020 Ariumi ..... H01Q 21/24
2020/0144714 A1* 5/2020 Noras ..... H01Q 15/0086

OTHER PUBLICATIONS

Chinese language office action dated Dec. 13, 2019, issued in application No. TW 108102350.
Rano, D., et al.; "Design and Analysis of Wearable Patch Antenna Array for MBAN Applications;" IEEE; 2016; pp. 1-6.
Wang, H., et al.; "Microstrip Patch Array Antenna Using a Parallel and Series Combination Feed Network;" 2018; pp. 1-2.

* cited by examiner

ANTENNA SYSTEM

CROSS REFERENCE TO RELATED APPLICATIONS

This application claims priority of Taiwan Patent Application No. 108102350 filed on Jan. 22, 2019, the entirety of which is incorporated by reference herein.

BACKGROUND OF THE INVENTION

Field of the Invention

The disclosure generally relates to an antenna system, and more particularly, to an antenna system with a large beam width.

Description of the Related Art

Antenna arrays have high directivity and high gain, and they are widely used in the fields of military technology, radar detection, life detection, and health monitoring. It has become a critical challenge for current designers to design antenna arrays with large beam widths applied to, for example, home security devices.

BRIEF SUMMARY OF THE INVENTION

In an exemplary embodiment, the invention is directed to an antenna system including a dielectric substrate, a ground plane, and a first antenna array. The dielectric substrate has a first surface and a second surface which are opposite to each other. The ground plane is disposed on the second surface of the dielectric substrate. The first antenna array is disposed on the first surface of the dielectric substrate. The first antenna array includes a first transmission line, a first antenna element, a second antenna element, a third antenna element, a fourth antenna element, a fifth antenna element, and a sixth antenna element. The first transmission line has a first feeding point and is coupled to the first antenna element, the second antenna element, the third antenna element, the fourth antenna element, the fifth antenna element, and the sixth antenna element. The first antenna element, the second antenna element, the third antenna element, the fourth antenna element, the fifth antenna element, and the sixth antenna element are all substantially arranged in a first straight line.

In some embodiments, the dielectric substrate is a single-layer board made of a Rogers RO4350B material.

In some embodiments, the dielectric substrate is a sixth-layer composite board made of a Rogers RO4350B material and an FR4 material.

In some embodiments, the operation frequency of the antenna system is substantially equal to 24 GHz.

In some embodiments, the beam width of the antenna system is substantially equal to 160 degrees.

In some embodiments, the gain of the antenna system is greater than 6 dBi within the beam width.

In some embodiments, each of the first antenna element, the second antenna element, the third antenna element, the fourth antenna element, the fifth antenna element, and the sixth antenna element includes a radiation element, a connection element, and an impedance adjustment element. The radiation element is coupled through the connection element and the impedance adjustment element to the first transmission line.

In some embodiments, the radiation element substantially has a rectangular shape.

In some embodiments, the length of the radiation element is from 0.15 to 0.25 wavelength of the operation frequency.

In some embodiments, the width of the radiation element is from 0.51 to 0.78 wavelength of the operation frequency.

In some embodiments, the length of the connection element is from 1.8 mm to 2.2 mm.

In some embodiments, the width of the connection element is from 0.3 mm to 0.5 mm.

In some embodiments, the length of the impedance adjustment element is substantially equal to 0.25 wavelength of the operation frequency.

In some embodiments, the width of the impedance adjustment element is greater than the width of the connection element.

In some embodiments, the antenna system further includes a second antenna array disposed on the first surface of the dielectric substrate. The second antenna array includes a second transmission line, a seventh antenna element, an eighth antenna element, a ninth antenna element, a tenth antenna element, an eleventh antenna element, and a twelfth antenna element.

In some embodiments, the second transmission line has a second feeding point and is coupled to the seventh antenna element, the eighth antenna element, the ninth antenna element, the tenth antenna element, the eleventh antenna element, and the twelfth antenna element.

In some embodiments, the seventh antenna element, the eighth antenna element, the ninth antenna element, the tenth antenna element, the eleventh antenna element, and the twelfth antenna element are substantially arranged in a second straight line.

In some embodiments, the second straight line is substantially parallel to the first straight line.

In some embodiments, the first antenna array and the second antenna array are mirror-symmetrical.

In some embodiments, the distance between the first antenna array and the second antenna array is longer than 3 wavelengths of the operation frequency.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
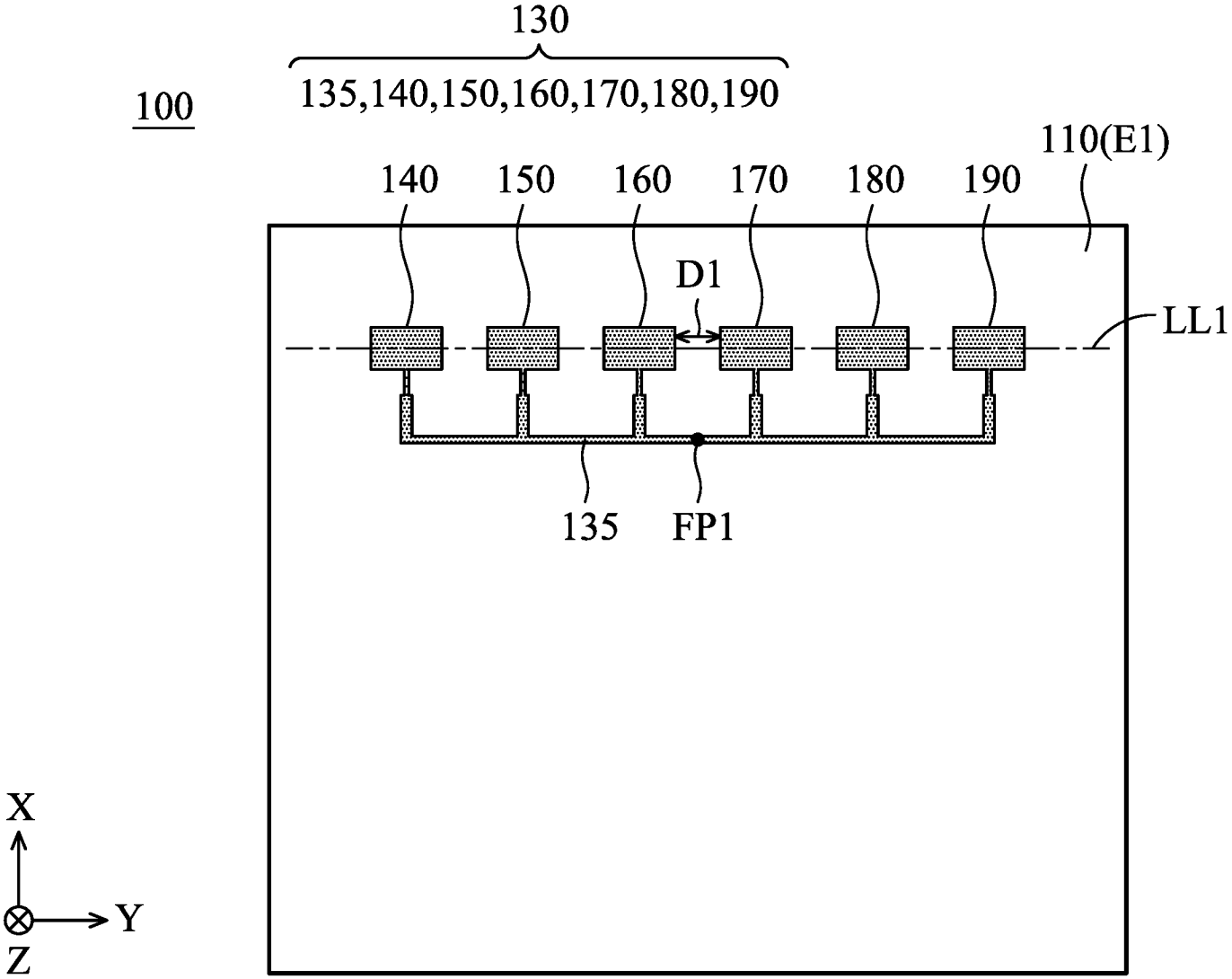
FIG. 1A is a top view of an antenna system according to an embodiment of the invention.
Figure 1B:
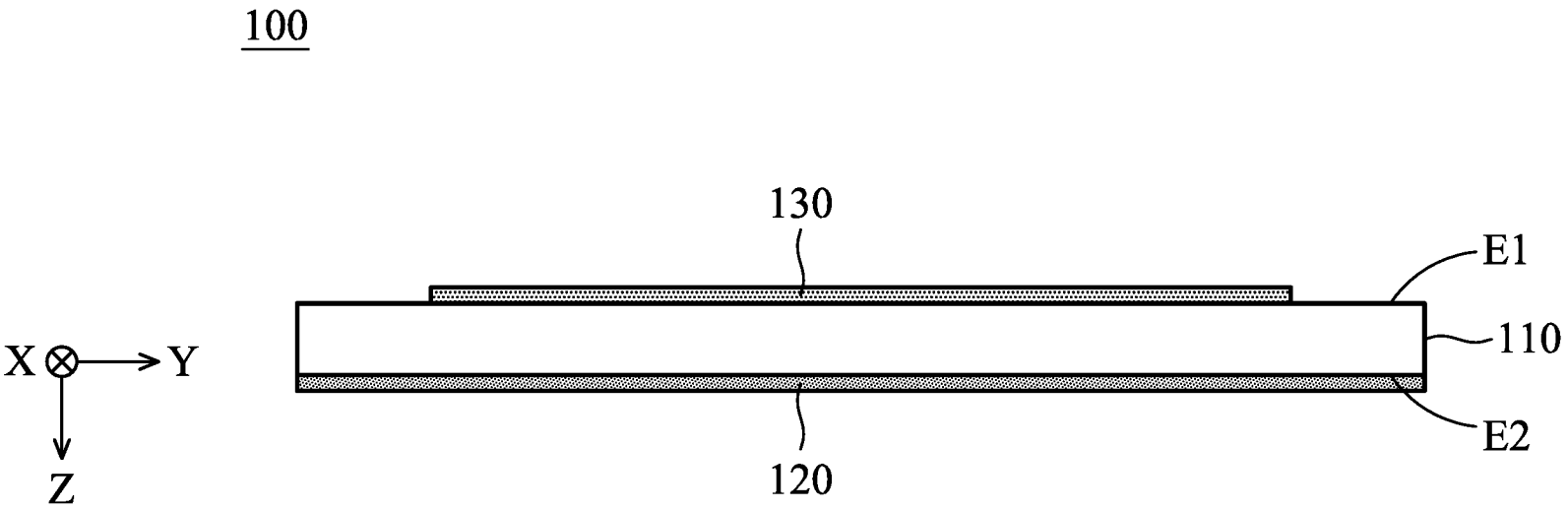
FIG. 1B is a side view of an antenna system according to an embodiment of the invention.

FIG. 1A is a top view of an antenna system 100 according to an embodiment of the invention. FIG. 1B is a side view of the antenna system 100 according to an embodiment of the invention. Please refer to FIG. 1A and FIG. 1B together. The antenna system 100 may be applicable to a communication device, such as a vehicle or a home security device. As shown in FIG. 1A and FIG. 1B, the antenna system 100 at least includes a dielectric substrate 110, a ground plane 120, and a first antenna array 130. Each of the ground plane 120 and the first antenna array 130 may be a respective metal plane.

The dielectric substrate 110 has a first surface E1 and a second surface E2 which are opposite to each other. The first antenna array 130 is disposed on the first surface E1 of the dielectric substrate 110. The ground plane 120 is disposed on the second surface E2 of the dielectric substrate 110. The ground plane 120 may substantially have a rectangular shape or a square shape, but it is not limited thereto. The first antenna array 130 has a first vertical projection on the second surface E2 of the dielectric substrate 110, and the whole first vertical projection is inside the ground plane 120. In some embodiments, the dielectric substrate 110 is a single-layer board made of a Rogers RO4350B material. The dielectric constant of the Rogers RO4350B material may be 3.85, and the loss tangent of the Rogers RO4350B material may be relatively small, such that the antenna system 100 can provide relatively ideal operation characteristics. In alternative embodiments, the dielectric substrate 110 is made of different materials.

The first antenna array 130 includes a first transmission line 135, a first antenna element 140, a second antenna element 150, a third antenna element 160, a fourth antenna element 170, a fifth antenna element 180, and a sixth antenna element 190. The first transmission line 135 may substantially have a straight-line shape. For example, the first transmission line 135 may be a microstrip line. The first transmission line 135 is coupled in parallel to the first antenna element 140, the second antenna element 150, the third antenna element 160, the fourth antenna element 170, the fifth antenna element 180, and the sixth antenna element 190. The first antenna element 140, the second antenna element 150, the third antenna element 160, the fourth antenna element 170, the fifth antenna element 180, and the sixth antenna element 190 are all substantially arranged in a first straight line LL1. Specifically, any adjacent two of the first antenna element 140, the second antenna element 150, the third antenna element 160, the fourth antenna element 170, the fifth antenna element 180, and the sixth antenna element 190 have the same distance D1 therebetween. It should be noted that the term "adjacent" or "close" over the disclosure means that the distance (spacing) between two corresponding elements is smaller than a predetermined distance (e.g., 5 mm or the shorter). The first transmission line 135 has a first feeding point FP1, which may be substantially positioned at the central point of the first transmission line 135. In some embodiments, a positive electrode of a first signal source (not shown) is coupled to the first feeding point FP1, and a negative electrode of the first signal source is coupled to the ground plane 120, so as to excite the first antenna array 130.

Figure 1C:
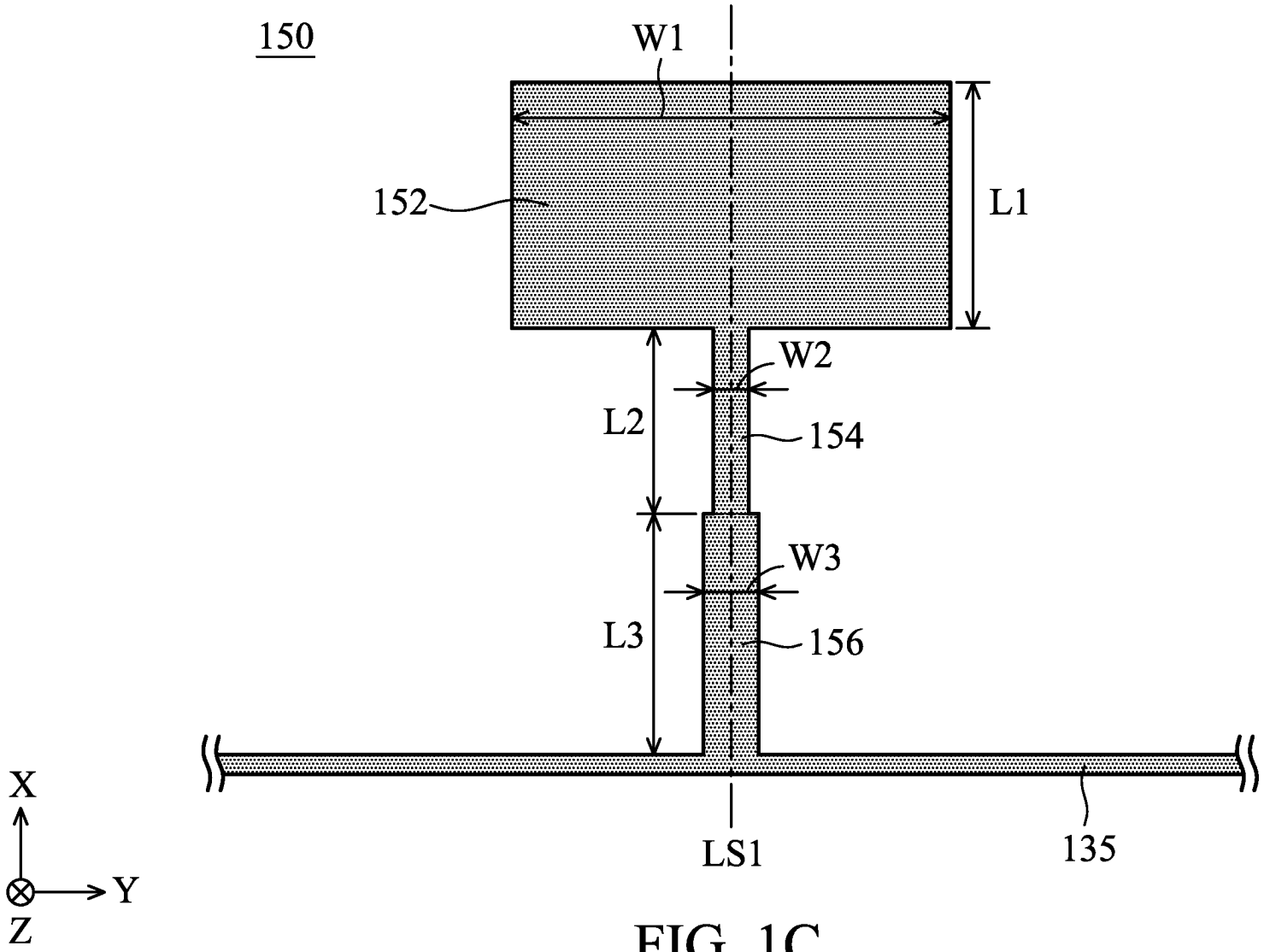
FIG. 1C is a top view of a second antenna element according to an embodiment of the invention.

FIG. 1C is a top view of the second antenna element 150 according to an embodiment of the invention. In the first antenna array 130, the first antenna element 140, the second antenna element 150, the third antenna element 160, the fourth antenna element 170, the fifth antenna element 180, and the sixth antenna element 190 have the same structures. It should be noted that FIG. 1C is exemplary to illustrate the detailed structure of the second antenna element 150, and the other antenna elements are not illustrated again herein (because they have the same structures). As shown in FIG. 1C, each of the first antenna element 140, the second antenna element 150, the third antenna element 160, the fourth antenna element 170, the fifth antenna element 180, and the sixth antenna element 190 includes a radiation element 152, a connection element 154, and an impedance adjustment element 156. The radiation element 152 may substantially have a rectangular shape or a square shape. The connection element 154 may substantially have a straight-line shape. The connection element 154 is coupled between the radiation element 152 and the impedance adjustment element 156. Specifically, the connection element 154 may be coupled to the central point of one side of the radiation element 152. The impedance adjustment element 156 may substantially have a straight-line shape. The radiation element 152 is coupled through the connection element 154 and the impedance adjustment element 156 to the first transmission line 135. The combination of the connection element 154 and the impedance adjustment element 156 may substantially have a variable-width structure. In some embodiments, the radiation element 152, the connection element 154, and the impedance adjustment element 156 are line-symmetrical with respect to their central line LS1.

Figure 2:
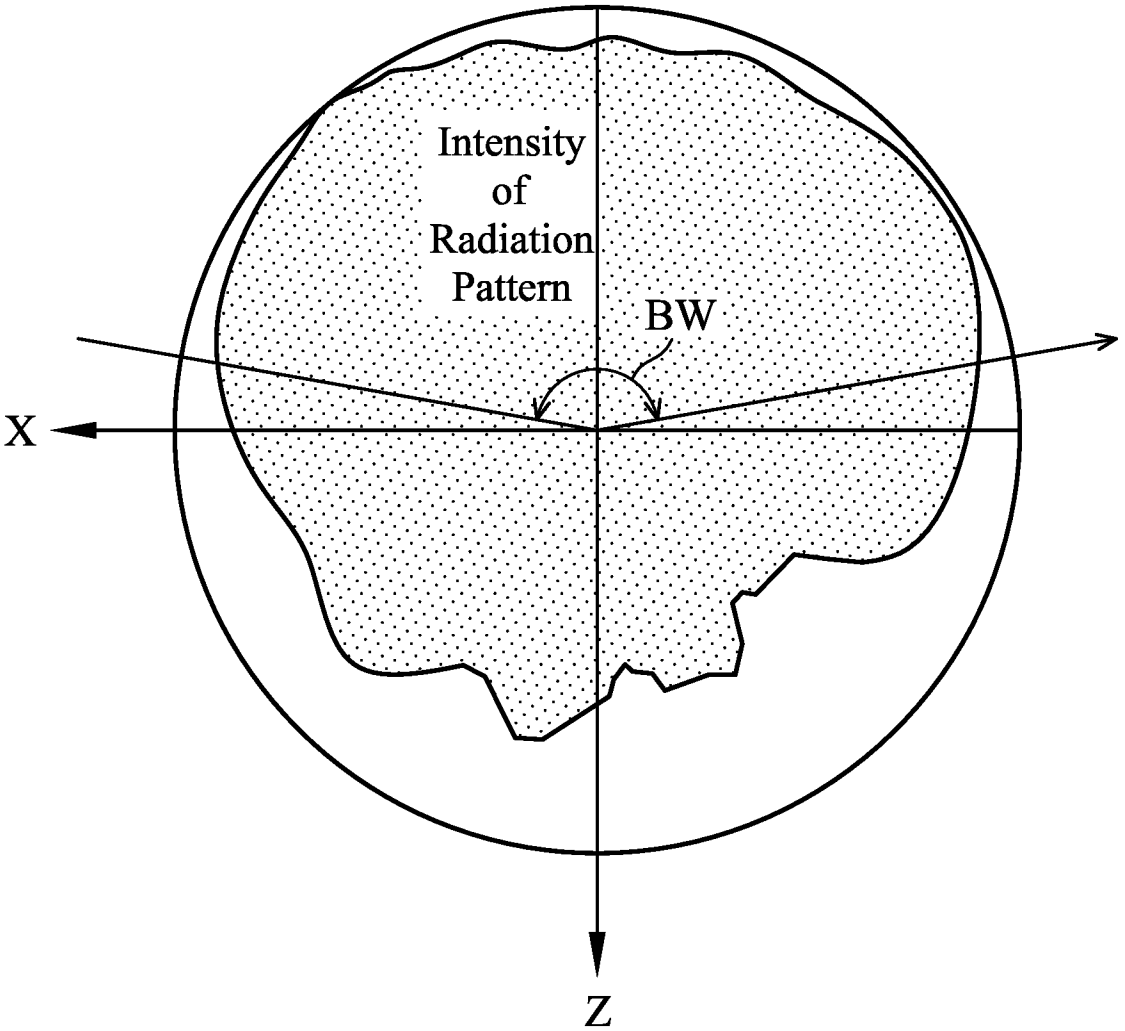
FIG. 2 is a radiation pattern of an antenna system according to an embodiment of the invention.

FIG. 2 is a radiation pattern of the antenna system 100 according to an embodiment of the invention. If the antenna system 100 is positioned at the original point, the radiation pattern of FIG. 2 may be measured on the XZ plane. The operation frequency of the antenna system 100 may be substantially equal to 24 GHz. According to the measurement of FIG. 2, the beam width BW of the antenna system 100 may be equal to about 160 degrees, and the gain of the antenna system 100 may be greater than 6 dBi within the beam width BW. It should be noted that if a 1×4 antenna array is used, the antenna gain may be often insufficient, and if a 2×4 antenna array is used, the radiation pattern may generate nulls. With the design of the invention, the antenna system 100 uses the 1×6 antenna array 130 instead, which is the best result based on many experiments, and it has the advantages of both high gain and large beam width.

In some embodiments, the element sizes of the antenna system 100 are described as follows. The length L1 of the radiation element 152 may be from 0.15 to 0.25 wavelength of the operation frequency of the antenna system 100, and may be preferably 0.21 wavelength. The width W1 of the radiation element 152 may be from 0.51 to 0.78 wavelength of the operation frequency of the antenna system 100, and may be preferably 0.65 wavelength. The length L2 of the connection element 154 may be from 1.8 mm to 2.2 mm, and may be preferably 2 mm. The width W2 of the connection element 154 may be from 0.3 mm to 0.5 mm, and may be preferably 0.4 mm. The length L3 of the impedance adjustment element 156 may be substantially equal to 0.25 wavelength (λ/4) of the operation frequency of the antenna system 100. The width W3 of the impedance adjustment element 156 may be greater than the width W2 of the connection element 154. For example, the aforementioned width W3 may be 1.5 to 2 times the aforementioned width W2, but it is not limited thereto. The distance D1 between any two adjacent antenna elements of the first antenna array 130 may be from 2.2 mm to 4.2 mm, and may be preferably 3.2 mm. The above ranges of element sizes are calculated and obtained according to many experiment results, and they help to optimize the beam width and impedance matching of the antenna system 100.

Figure 3:
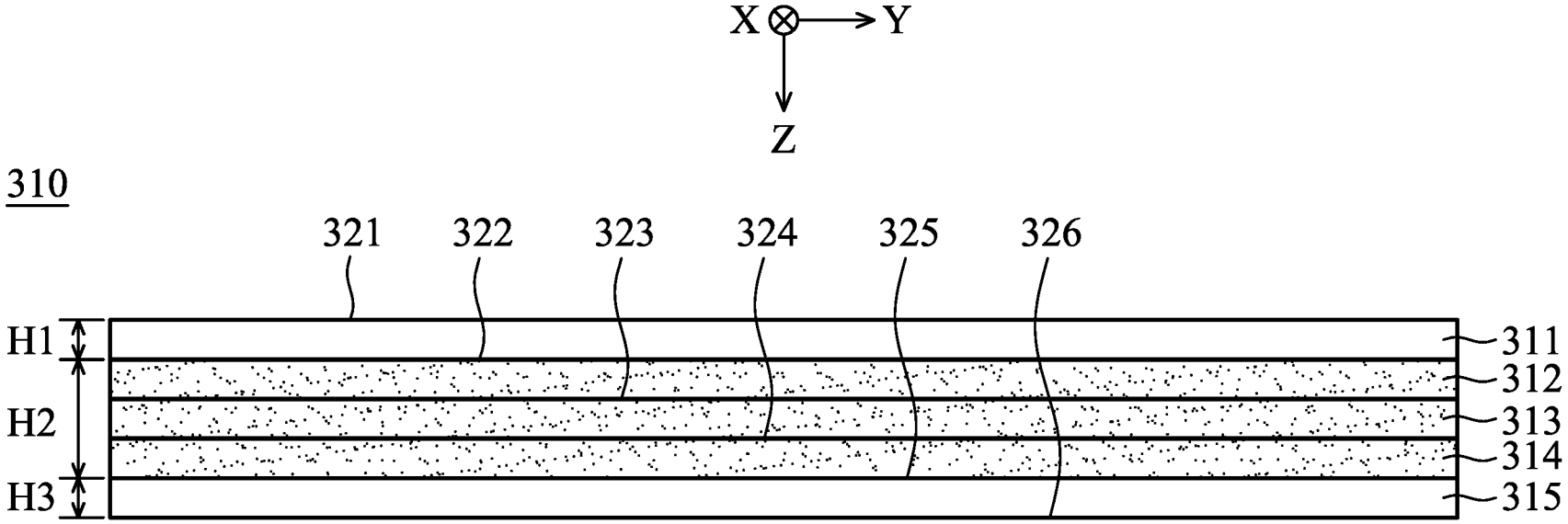
FIG. 3 is a side view of a dielectric substrate according to another embodiment of the invention.

FIG. 3 is a side view of a dielectric substrate 310 according to another embodiment of the invention. In the embodiment of FIG. 3, the dielectric substrate 310 is a sixth-layer composite board made of a Rogers R04350B material and an FR4 (Flame Retardant 4) material. The dielectric constant of the FR4 material may be 4.3. Specifically, the dielectric substrate 310 includes a first dielectric layer 311, a second dielectric layer 312, a third dielectric layer 313, a fourth dielectric layer 314, a fifth dielectric layer 315, a first metal layer 321, a second metal layer 322, a third metal layer 323, a fourth metal layer 324, a fifth metal layer 325, and a sixth metal layer 326. The first metal layer 321, the second metal layer 322, the third metal layer 323, the fourth metal layer 324, the fifth metal layer 325, and the sixth metal layer 326 may be interleaved with the first dielectric layer 311, the second dielectric layer 312, the third dielectric layer 313, the fourth dielectric layer 314, and the fifth dielectric layer 315. For example, the first dielectric layer 311 and the fifth dielectric layer 315 may both be made of the Rogers R04350B material. The second dielectric layer 312, the third dielectric layer 313, and the fourth dielectric layer 314 may all be made of the FR4 material. In addition, the first metal layer 321, the second metal layer 322, the third metal layer 323, the fourth metal layer 324, the fifth metal layer 325, and the sixth metal layer 326 may be coupled to each other by one or more conductive via elements. When the dielectric substrate 310 is applied to the antenna system 100 of FIG. 1, the aforementioned first antenna array 130 may be formed by the first metal layer 321, and the aforementioned ground plane 120 may be formed by the sixth metal layer 326. With respect to element sizes, the total thickness H2 of the second dielectric layer 312, the third dielectric layer 313, and the fourth dielectric layer 314 may be about 2 to 3 times (e.g., 2.6 times) the thickness H1 of the first dielectric layer 311, and may also be 2 to 3 times (e.g., 2.6 times) the thickness H3 of the fifth dielectric layer 315. For example, the aforementioned thickness H1/H3 may be about 10 mil, and the aforementioned thickness H2 may be about 26 mil. According to the practical measurement, if the dielectric substrate 310 of FIG. 3 is used, the beam width and the gain therein relative to the antenna system 100 will be significantly improved.

Figure 4:
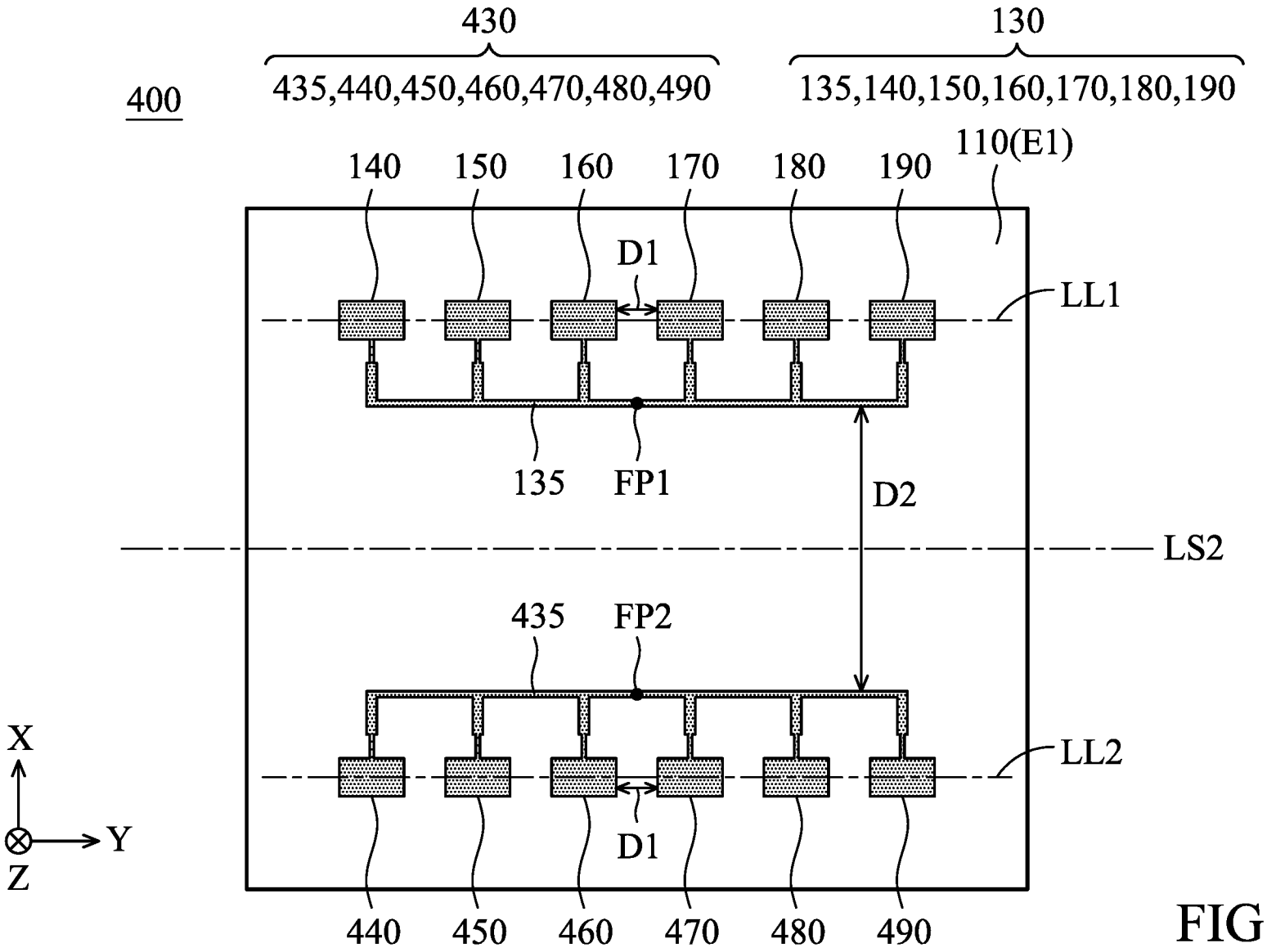
FIG. 4 is a top view of an antenna system according to another embodiment of the invention.

FIG. 4 is a top view of an antenna system 400 according to another embodiment of the invention. FIG. 4 is similar to FIG. 1A. In the embodiments of FIG. 4, the antenna system 400 further includes a second antenna array 430. The second antenna array 430 is also disposed on the first surface E1 of the dielectric substrate 110. The second antenna array 430 has a second vertical projection on the second surface E2 of the dielectric substrate 110, and the whole second vertical projection is inside the ground plane 120. The first antenna array 130 and the second antenna array 430 may be mirror-symmetrical. For example, the first antenna array 130 and the second antenna array 430 may be line-symmetrical with respect to their central line LS2. In some embodiments, one of the first antenna array 130 and the second antenna array 430 is coupled to a transmitter (TX), and the other of the first antenna array 130 and the second antenna array 430 is coupled to a receiver (RX). Similarly, the second antenna array 430 includes a second transmission line 435, a seventh antenna element 440, an eighth antenna element 450, a ninth antenna element 460, a tenth antenna element 470, an eleventh antenna element 480, and a twelfth antenna element 490. The second transmission line 435 is coupled in parallel to the seventh antenna element 440, the eighth antenna element 450, the ninth antenna element 460, the tenth antenna element 470, the eleventh antenna element 480, and the twelfth antenna element 490. The seventh antenna element 440, the eighth antenna element 450, the ninth antenna element 460, the tenth antenna element 470, the eleventh antenna element 480, and the twelfth antenna element 490 are all substantially arranged in a second straight line LL2. The second straight line LL2 may be substantially parallel to the aforementioned first straight line LL1. The second transmission line 435 has a second feeding point FP2, which may be substantially positioned at the central point of the second transmission line 435. The detailed structure of each of the seventh antenna element 440, the eighth antenna element 450, the ninth antenna element 460, the tenth antenna element 470, the eleventh antenna element 480, and the twelfth antenna element 490 has been described in the embodiment of FIG. 1C, and it will not be illustrated again herein. In some embodiments, a positive electrode of a second signal source (not shown) is coupled to the second feeding point FP2, and a negative electrode of the second signal source is coupled to the ground plane 120, so as to excite the second antenna array 430. In some embodiments, the distance D2 between the first antenna array 130 and the second antenna array 430 (or the distance D2 between the first transmission line 135 and the second transmission line 435) is longer than 3 wavelengths of the operation frequency of the antenna system 400, so as to increase the isolation between the first antenna array 130 and the second antenna array 430. Other features of the antenna system 400 of FIG. 4 are similar to those of the antenna system 100 of FIG. 1A and FIG. 1B. Accordingly, the two embodiments can achieve similar levels of performance.

Figure 5:
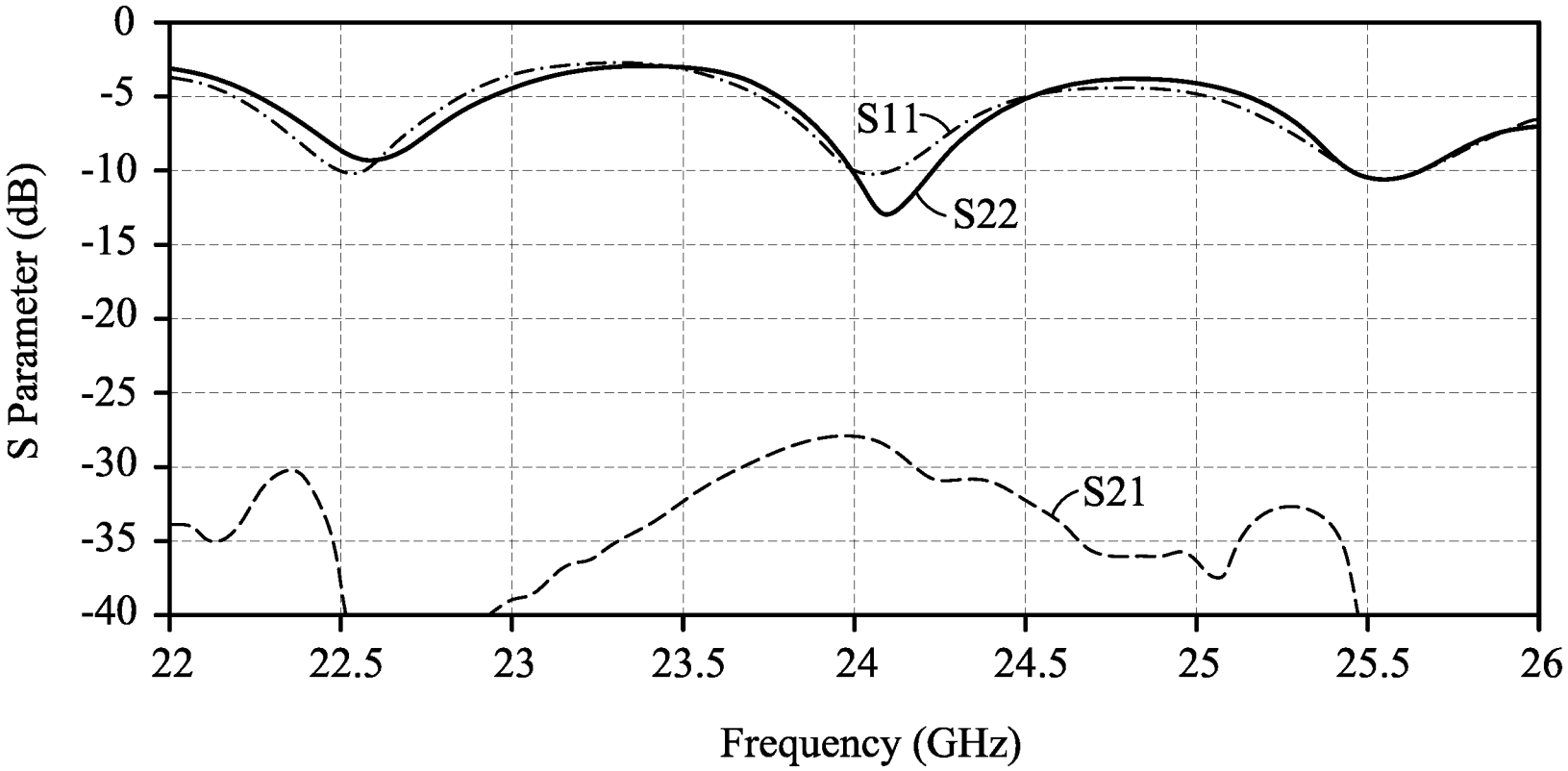
FIG. 5 is a diagram of S-parameters of an antenna system according to another embodiment of the invention.

FIG. 5 is a diagram of S-parameters of the antenna system 400 according to another embodiment of the invention. The horizontal axis represents the operation frequency (GHz), and the vertical axis represents the S-parameters (dB). In the embodiment of FIG. 5, the first feeding point FP1 of the first antenna array 130 is used as a first port (Port 1), and the second feeding point FP2 of the second antenna array 430 is used as a second port (Port 2). The S11 curve, the S22 curve, and the S21 curve represent the S11 parameter, the S22 parameter, and the S21 parameter, respectively. According to the measurement of FIG. 5, both the first antenna array 130 and the second antenna array 430 can cover the 24 GHz operation frequency band, and the isolation (i.e., the absolute value of the aforementioned S21 parameter) between the first antenna array 130 and the second antenna array 430 may be at least about 25 dB. This isolation can meet the requirements of practical applications of general antenna systems. For example, the practical applications include antenna systems used in the fields of military technology (including obstacle detection and through-wall detection but not limited thereto), car radar detection, car communication, live-motion detection, or life-signal detection (including the detection of heartbeat, breath rate, blood oxygen, and blood pressure but not limited thereto).

Figure 6:
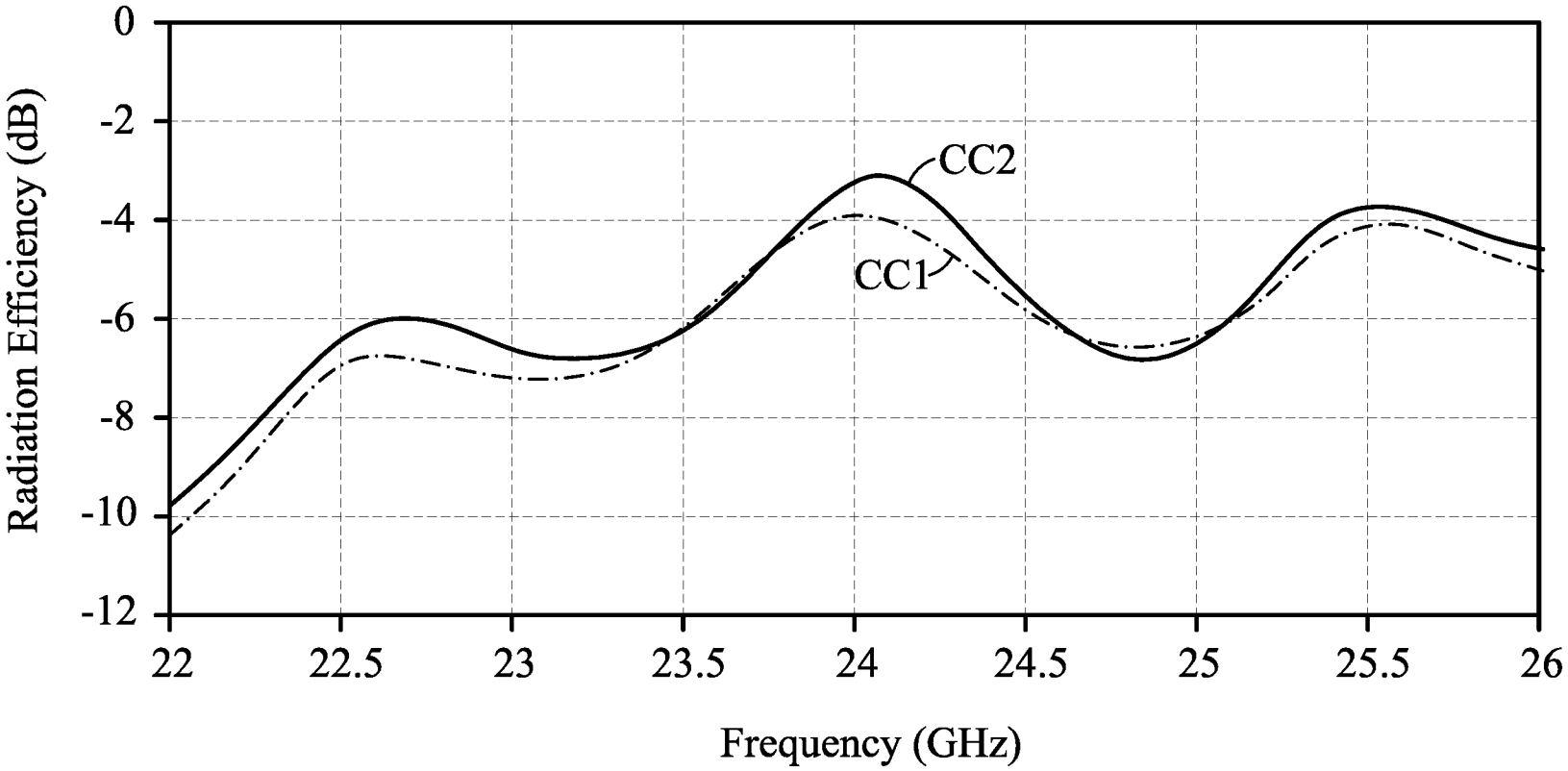
FIG. 6 is a diagram of radiation efficiency of an antenna system according to another embodiment of the invention.

FIG. 6 is a diagram of radiation efficiency of the antenna system 400 according to another embodiment of the invention. The horizontal axis represents the operation frequency (GHz), and the vertical axis represents the radiation efficiency (dB). According to the measurement of FIG. 6, at the 24 GHz operation frequency band, the radiation efficiency of each of the first antenna array 130 and the second antenna array 430 is at least −4 dB, which represents that the antenna system 400 have high-efficiency and low-loss characteristics.

The invention proposes a novel antenna system which includes at least one 1×6 antenna array. In conclusion, the invention has at least the advantages of small size, large beam width, low loss, high gain, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements, so as to satisfy the design requests. For example, the antenna array may be designed to operate at other millimeter-wave frequencies (e.g., 38 GHz, 60 GHz, 77 GHz, or 94 GHz, but not limited thereto) referring to the design rules or settings of the invention. It should be understood that the antenna system of the invention is not limited to the configurations of FIGS. 1-6. The invention may include any one or more features of any one or more embodiments of FIGS. 1-6. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna system, comprising:

a dielectric substrate, having a first surface and a second surface opposite to each other;

a ground plane, disposed on the second surface of the dielectric substrate; and a first antenna array, disposed on the first surface of the dielectric substrate, and comprising a first transmission line, a first antenna element, a second antenna element, a third antenna element, a fourth antenna element, a fifth antenna element, and a sixth antenna element;

wherein the first transmission line has a first feeding point and is coupled to the first antenna element, the second antenna element, the third antenna element, the fourth antenna element, the fifth antenna element, and the sixth antenna element;

wherein the first antenna element, the second antenna element, the third antenna element, the fourth antenna element, the fifth antenna element, and the sixth antenna element are substantially arranged in a first straight line;

wherein an operation frequency of the antenna system is substantially equal to 24 GHz;

wherein each of the first antenna element, the second antenna element, the third antenna element, the fourth antenna element, the fifth antenna element, and the sixth antenna element comprises a radiation element, a connection element, and an impedance adjustment element, and wherein the radiation element is coupled through the connection element and the impedance adjustment element to the first transmission line;

wherein a width of the radiation element is from 0.51 to 0.78 wavelength of the operation frequency;

wherein a length of the radiation element is from 0.15 to 0.25 wavelength of the operation frequency;

wherein the dielectric substrate comprises a first dielectric layer, a second dielectric layer, a third dielectric layer, a fourth dielectric layer, a fifth dielectric layer, a first metal layer, a second metal layer, a third metal layer, a fourth metal layer, a fifth metal layer, and a sixth metal layer; and wherein the first metal layer, the second metal layer, the third metal layer, the fourth metal layer, the fifth metal layer, and the sixth metal layer are interleaved with the first dielectric layer, the second dielectric layer, the third dielectric layer, the fourth dielectric layer, and the fifth dielectric layer.

2. The antenna system as claimed in claim 1, wherein the dielectric substrate is a sixth-layer composite board made of a Rogers R04350B material and an FR4 material.

3. The antenna system as claimed in claim 1, wherein a beam width of the antenna system is substantially equal to 160 degrees.

4. The antenna system as claimed in claim 3, wherein a gain of the antenna system is greater than 6 dBi within the beam width.

5. The antenna system as claimed in claim 1, wherein the radiation element substantially has a rectangular shape.

6. The antenna system as claimed in claim 1, wherein a length of the connection element is from 1.8 mm to 2.2 mm.

7. The antenna system as claimed in claim 1, wherein a width of the connection element is from 0.3 mm to 0.5 mm.

8. The antenna system as claimed in claim 1, wherein a length of the impedance adjustment element is substantially equal to 0.25 wavelength of the operation frequency.

9. The antenna system as claimed in claim 1, wherein a width of the impedance adjustment element is greater than a width of the connection element.

10. The antenna system as claimed in claim 1, further comprising:

a second antenna array, disposed on the first surface of the dielectric substrate, and comprising a second transmission line, a seventh antenna element, an eighth antenna element, a ninth antenna element, a tenth antenna element, an eleventh antenna element, and a twelfth antenna element.

11. The antenna system as claimed in claim 10, wherein the second transmission line has a second feeding point and is coupled to the seventh antenna element, the eighth antenna element, the ninth antenna element, the tenth antenna element, the eleventh antenna element, and the twelfth antenna element.

12. The antenna system as claimed in claim 10, wherein the seventh antenna element, the eighth antenna element, the ninth antenna element, the tenth antenna element, the eleventh antenna element, and the twelfth antenna element are substantially arranged in a second straight line.

13. The antenna system as claimed in claim 12, wherein the second straight line is substantially parallel to the first straight line.

14. The antenna system as claimed in claim 10, wherein the first antenna array and the second antenna array are mirror-symmetrical.

15. The antenna system as claimed in claim 10, wherein a distance between the first antenna array and the second antenna array is longer than 3 wavelengths of the operation frequency.

* * * * *